United States Patent [19]

Belyavsky et al.

[11] Patent Number: 4,491,314

[45] Date of Patent: Jan. 1, 1985

[54] UNEVEN BARS

[75] Inventors: Alexandr D. Belyavsky; Gennady M. Borozdinov; Vitaly M. Vasiliev; Viktor I. Kalognomos; Nikolai A. Komov; Gennady A. Pavlov; Evgeny L. Persits; July M. Sergienko; Jury A. Svirin; Boris V. Titov, all of Moscow, U.S.S.R.

[73] Assignee: Nauchno-Issledovatelsky I Kostruktorsky Institut, Moscow, U.S.S.R.

[21] Appl. No.: 457,671

[22] Filed: Jan. 13, 1983

[30] Foreign Application Priority Data

Jan. 13, 1982 [SU] U.S.S.R. ..... 3392651

[51] Int. Cl.[3] ..... A63B 3/00

[52] U.S. Cl. ..... 272/63

[58] Field of Search ..... 272/62, 61, 63, 109

[56] References Cited

U.S. PATENT DOCUMENTS 4,402,501 9/1983 Lohman ..... 272/63

FOREIGN PATENT DOCUMENTS 1578647 10/1975 Fed. Rep. of Germany ..... 272/63
7811685 11/1979 France ..... 272/63
597374 3/1978 U.S.S.R. ..... 272/63

*Primary Examiner*—Richard J. Apley
*Assistant Examiner*—S. R. Crow
*Attorney, Agent, or Firm*—Burgess, Ryan & Wayne

[57] ABSTRACT

Adjustable uneven bars are used for gymnastic competition and training of sportsmen, the uneven bars comprising two parallel handrails mounted on the top ends of two pair of uneven uprights, each pair of uneven uprights being braced by a pair of tensioning cables and being equipped with an automatic cable tension control device, a handrail spacing adjuster connected between the uprights of each pair of uneven uprights and linked mechanically with the automatic cable tension control device of the corresponding pair of uneven uprights, each handrail spacing adjuster provided with a hand drive crank and an electric drive motor, and an interlocking device which prevents simultaneous operation of both motors.

4 Claims, 3 Drawing Figures

UNEVEN BARS

FIELD OF THE INVENTION

The present invention relates to sports equipment and relates more particularly to uneven bars used for various competitions and training of gymnasts.

BACKGROUND OF THE INVENTION

Widely known in the art are uneven bars comprising two parallel handrails, two pairs of uneven uprights carrying the handrails on the top ends, bases supporting the uprights, two pairs of tensioning cables with turnbuckles and a handrail spacing adjuster.

The handrail spacing adjuster is essentially a lead screw with a crank at the end. The lead screw can be rotated and is pivotally connected to one of the uprights. The lead screw nut is rigidly fixed within a tube attached to the other related upright.

When rotated by the crank the lead screw displaces the nut, thereby altering the distance between the handrails.

These uneven bars are not provided with a cable tension control device and, therefore the tension of the cables changes so much after every adjustment of the bars that use of the turnbuckles and swivel tighteners is necessary to restore the cable tension to within 2750±150 N (275±15 kgf) as specified by the FIG. regulations. Much time is lost by such adjustment, and execution of exercises by gymnasts is accordingly hindered during competition.

Known in the art are also uneven bars of the NOUANSPORT Society, which comprise two parallel handrails, two pairs of uneven uprights, two pairs of tensioning cables provided with turnbuckles, handrail spacing adjusters arranged between the longer and shorter uprights and a cable tension control device.

The cable tension control device is actually a screw on which a slider (a nut) can move varying the tension of the bracing cable leg attached to the nut.

The handrail spacing adjuster and cable tension control device are interconnected mechanically, being actuated by a hand drive crank.

The handrail spacing adjuster is essentially a mechanism consisting of a lead screw and a nut fixed in a tube pivotally attached to the shorter upright. The nut moves along the lead screw connected with a gear-box whose case is rigidly mounted on each longer upright. Fixed on the lead screw running on the gear-box bearings is a gear meshed with another gear mounted on the hand drive crank axle. The gear mounted on the hand drive crank axle is in mesh with the cable tension control device gear.

The cable tension control device also comprises a lead screw carrying a gear rigidly attached to the screw and meshed with the gear mounted on the hand drive crank axle. Movable along the lead screw is a nut to which one end of the tensioning cable is attached and which is held against rotation by a pin snugly fit in the nut and slidably installed in the slots of the tube encasing the lead screw and the nut. The tube is securely fixed to the gear-box case. Such an arrangement provides alteration of the distance between the handrails due to rotation of the crank, with the cable tension being maintained constant.

However, an additional torque must be applied to the crank during adjustment of the handrail spacing with the cable tension kept constant. Considerable efforts and much time are needed to set the required distance between the handrails, which presents difficulty during competitions. For example, a team of six gymnasts can hardly accomplish warm-up exercises within the alloted warm-up time.

SUMMARY OF THE INVENTION

It is an object of the present invention to construct uneven bars with such handrail spacing adjusters that would allow cutting-down of the bars' adjustment time.

Another object is to provide convenience in servicing the bars.

Still another object is to make such uneven bars adaptable for use in various gyms and sports halls.

In accordance with these and other objects the invention resides in uneven bars comprising two parallel handrails mounted on the upper ends of two pairs of uneven uprights, each pair having a pair of tensioning cables, a cable tension automatic control device and a handrail spacing adjuster provided with a hand drive crank, arranged between the uneven uprights and mechanically linked with the cable tension automatic control device. According to the invention, each handrail spacing adjuster in addition to the hand drive is equipped with an electric motor drive whose reduction gear is mechanically connected with the cable tension automatic control device, and a device interlocking any one of the drives, linked with the hand drive crank and built into the kinematic train interconnecting the electric motor drive reduction gear and the cable tension automatic control device, wherein the hand drive crank is adapted for axial movement at will.

The availability of the hand and electric motor drives makes it possible to use such uneven bars under any conditions in any sports halls. The electric motor drive permits the bars' adjustment time to be considerably reduced and offers a means of eliminating manual, rather laborious operations in the course of competition.

The interlocking device makes it possible to use either of the two drives, depending on the conditions under which competitions take place, with no need of carrying out additional re-arrangements. It rules out the possibility of simultaneous operation of both drives, thereby assuring higher reliability in use and safety in servicing of the bars.

In accordance with the invention, it is preferred that the electric motor drives of the handrail spacing adjusters be interconnected by a common control system comprising handrail position transmitters, linked mechanically with the handrail spacing adjusters and connected electrically with a handrail position indicator, and a remotely controlled handrail spacing selector, wherein the output terminals of the selector and indicator being connected to the electric motor drive control circuit through a comparator.

The proposed electric motor drive control system incorporated in the novel construction of the uneven bars permits automatic adjustment of the bars and makes it possible to preset the desired handrail spacing (with a view to adapting the bars to the height of the next performer in the course of competitions or warming-up exercises) on the selector and to set the preselected handrail spacing in the uneven bars by actuating the "start" button after dismount of the previous performer.

It is expedient that the interlocking device be made up of a bell-crank lever and a tooth-type coupling, with one half-coupling slidably mounted on the output shaft of the reduction gear and spring-biased to the other half-coupling fixed on the lead screw of the cable tension automatic control device, and one arm of the bell-crank lever be kept permanently in contact with the hand drive crank, while the other arm thereof through the medium of a sleeve is in contact with the half-coupling mounted on the reduction gear output shaft, the sleeve enclosing the half-coupling on the lead screw with a clearance.

Such an embodiment of the interlocking device is simple, space-saving, visually observed in operation, and is not cumbersome in construction.

In accord with the invention each cable tension automatic control device is preferably equipped with rods each attached to the nut of the device lead screw at one end and carrying a roller at the other end, one roller being embraced by the cable terminating at the other roller, and with a tension compensating corrector mounted on the longer upright and having a profiled working surface constantly kept in an intimate contact with the roller at which the cable terminates, the working surface being formed by a second-degree curve.

The cable tension automatic control device of such construction makes it possible to maintain the tension of the cables constant when the handrails are moved closer together or further apart. In known currently available uneven bars the compensation of the cable tension during adjustment of the handrail spacing follows the linear law specific to the screw pair movement, while the top of each articulated upright follows an arc, which results in an accumulation of errors and in a change of the predetermined tension of the cable.

Use of the tension compensating corrector in accord with the invention offers means of avoiding accumulation of the cable tension error owing to the proportional corrective action.

The proposed uneven bars have proved to be a substantial advance over the prior art and possess certain distinctive features which make it possible:

to considerably increase the intensity of competition and training of sportsmen due to curtailment of time spent on adjustment of the bars;

to appreciably cut down the bars adjustment time owing to combination of certain operations and use of an automatic adjuster;

to substitute manual adjustment of the bars involving tensioning of the bracing cables and alteration of the handrail spacing by merely depressing the electric motor drive control button, which makes it possible to reduce the number of servicing personnel during competitions by nearly one half;

to remotely monitor the parameters of the bars without interruption of exercises;

to remotely adjust the distance between the handrails.

The use of the hand and electric motor drives allows these bars to be used under various conditions and in different sports halls.

The interlocking device incorporated in the bars construction excludes simultaneous operation of both drives, thereby providing safety in servicing of the bars.

BRIEF DESCRIPTION OF THE DRAWINGS

A specific embodiment of the present invention will now be described in detail, by way of example only, with reference to the accompanying drawings, in which.

DETAILED DESCRIPTION OF THE INVENTION

Figure 1:
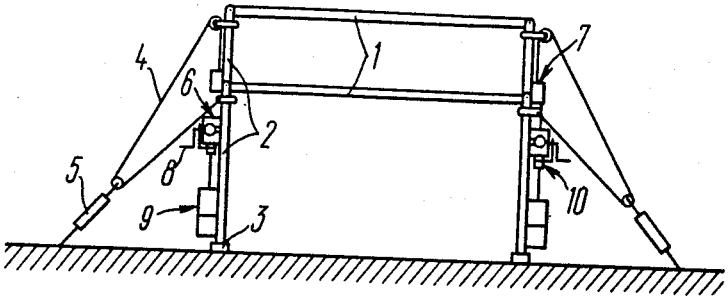
FIG. 1 shows a general schematic view of the uneven bars.

The uneven bars comprise two parallel handrails 1 (FIG. 1), two pairs of uneven uprights 2 carrying the handrails on the top ends, and bases 3 from which the uprights upstand. Each pair of uneven uprights 2 is provided with a pair of tensioning cables 4 with turnbuckles 5 anchored to the sports hall floor, a handrail spacing adjuster 6 disposed between two adjacent uprights 2 and an automatic control device 7 for maintaining the tension of the cables 4 as constant as possible.

The handrail spacing adjuster 6 (FIG. 2) of each pair of the uneven uprights 2 is disposed between the uprights 2, linked mechanically with the cable tension automatic control device 7 and has a hand drive crank 8 (FIG. 1), an electric motor drive 9 and a device 10 locking either of the two drives, wherein the electric motor drive 9 (FIG. 2) comprises a reduction gear 11 whose output shaft 12 is linked mechanically with the cable tension automatic control device 7. The drive interlocking device 10 is connected with the hand drive crank 8 slidably mounted for axial movement at will, being built into the kinematic chain interconnecting the reduction gear 11, the electric motor drive 9 and the cable tension automatic control device 7.

Each handrail spacing adjuster 6 is essentially of a known construction and comprises a lead screw 13 mounted in the bearings of gear-box case 14 and a nut 15 fixed inside a hollow rod 16 attached to the shorter upright 2. The gear-box case 14 is secured to the longer upright 2. The lead screw 13 is supported at one end by the gear-box case bearings and has a bevel gear 17 at this end.

Each cable tension automatic control device 7 comprises a lead screw 18, a nut 19, two pairs of rods 20 (FIG. 3) and 21, each pair carrying rollers 22 and 23 respectively, and a tension compensating corrector 24 having a flat substantially vertical surface B and a profiled curved surface C formed by a second-degree curve.

The lead screw 18 is installed along the longer upright 2 in the bearings of the gear-box case 14, being provided with a bevel gear 25 inside the gear-box and a nut 19 at the screw end protruding from the gear-box case 14. The nut 19 (FIG. 2) has two trunnions, each carrying a pivotally attached pair of rods 20 and 21. Installed on the top end of each rod 20 is a roller 22 (FIG. 3) making contact with the profiled surface C of the tension compensating corrector 24, while each one of the rods 21 has a similarly installed roller 23 contacting the flat surface B of the corrector. As shown in FIG. 3, roller 23 is wrapped by the cable 4 whose end is secured to the roller 22 in any known manner so that the roller 22 is free to rotate. Such an embodiment keeps the rollers 22 and 23 in contact with the respective surfaces of the tension compensating corrector 24 all the time. The bevel gear 25 of the lead screw 18 is always in mesh with gear 17 (FIG. 2) of the lead screw 13, thereby ensuring a mechanical connection of the handrail spacing adjuster 6 with the cable tension automatic control device 7.

The hand drive crank 8 (FIG. 3) is mounted on axle 26 installed in a guide sleeve of the gear-box case 14. Mounted on the free end of axle 26 is a bevel gear 27 which is out of mesh with the bevel gear 25 of the cable tension automatic control device 7, when found in the extreme outward position. As it was stated above, the hand drive crank 8 is slidably mounted relative to its rotation axis, since axle 26 is installed freely in the guide sleeve of the gear-box case 14. If the hand drive crank 8 is pressed axially inwards, the axle 26 moves towards the gear-box case 14, meshing the bevel gear 27 with the bevel 25 of the cable tension automatic control device 7, thereby ensuring a mechanical connection of the crank with the handrail spacing adjuster 6 via the cable tension automatic control device 7.

The electric motor and reduction gear 11 of the electric motor drive 9 (FIG. 2) are mounted at the bottom part of the longer upright 2 so that the output shaft 12 of the reduction gear 11 is laid out substantially parallel to this upright 2. The output shaft 12 through the interlocking device 10 and the shaft 28 which is actually an extension of the lead screw 18 accomplish a mechanical linkage between the electric motor drive 9 and cable tension automatic control device 7.

The interlocking device 10 (FIG. 3) comprises a bell-crank lever 29 and a tooth-type coupling consisting of half-couplings 30 and 31. The half-coupling 30 is secured on the shaft 28, while the half-coupling 31 is slidably keyed on the output shaft. Retainer 32 is fixed and spring 33 is put on the output shaft 12 so that one end of the spring rests on the retainer 32, while the other end thereof thrusts against the end face of the half-coupling 31, keeping the latter spring-loaded in the direction of the half-coupling 30.

One arm of the bell-crank lever 29 is invariably in contact with the hand drive crank 8, being inserted into a slot in the axle 26, the other arm of the bell-crank lever 29 carrying a sleeve is always in contact with the half-coupling 31, said sleeve being installed freely and coaxially relative to and enclosing the half-coupling 30. The rotation axle of the bell-crank lever 29 is mounted on the gear-box case 14 as shown in FIG. 3.

Figure 2:
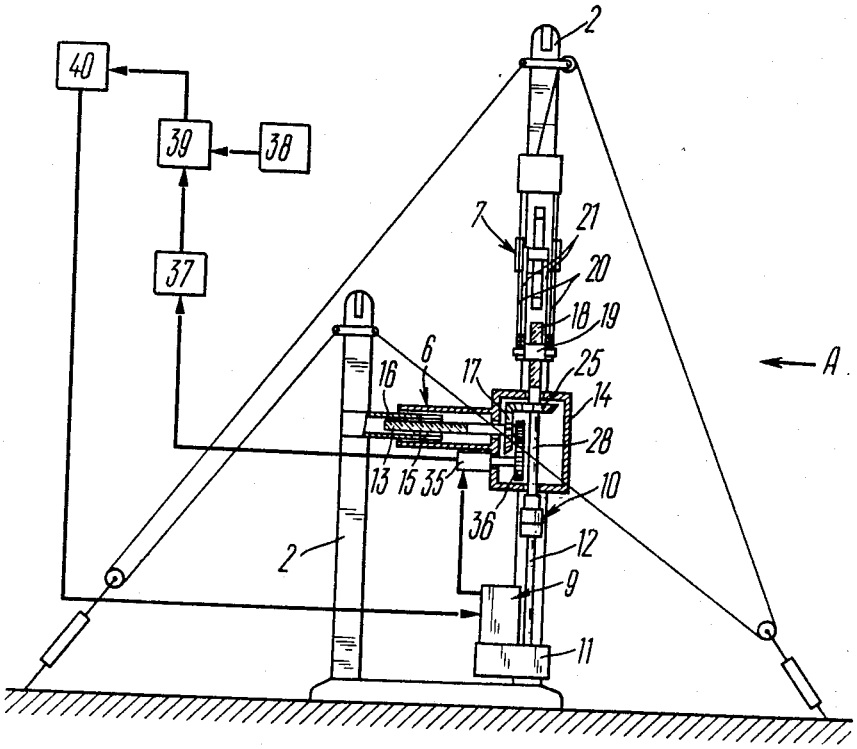
FIG. 2 is a side view of the uneven bars in an enlarged scale.
Figure 3:
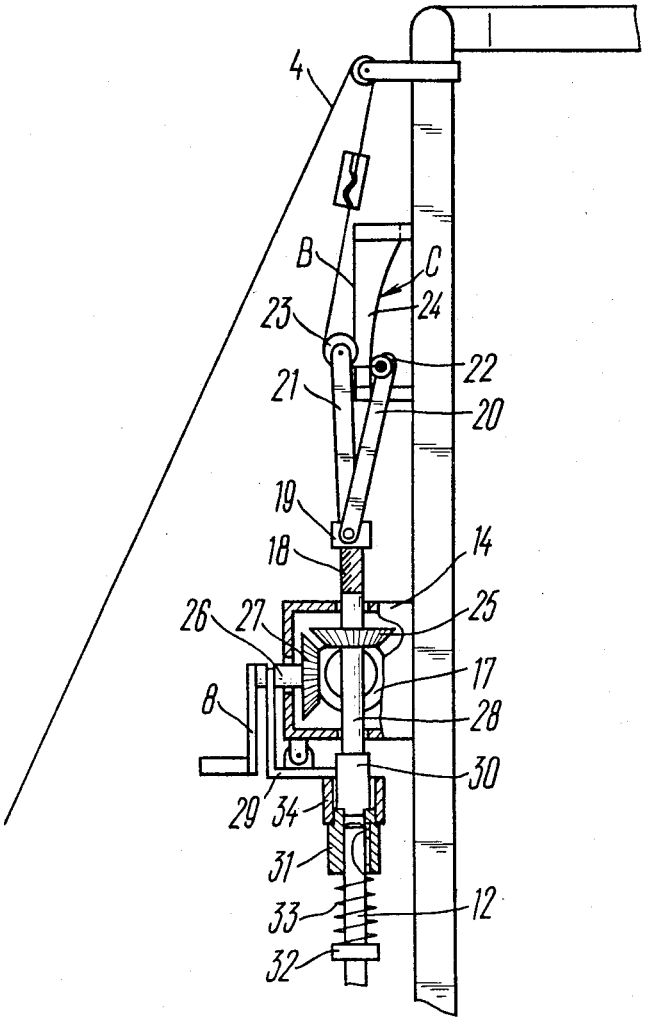
FIG. 3 is a view in the direction of arrow A in FIG. 2.

To synchronize the operation of the electric motor drives 9 of both pairs of the uprights 2, the drives are electrically connected into a common control system which may be of a known type or of the kind shown in FIG. 2.

The control system comprises two handrail position transmitters 35 each geared by means of a couple of gears 36 to the handrail spacing adjuster 6, a handrail position indicator 37 and a handrail spacing selector 38; the indicator 37 and selector 38 are connected with the transmitters 35, the output terminals thereof are connected into the electric motor control circuit 40 of the electric motor drives 9 through a comparator 39.

The common control system may be formed of any known elements with a view to remotely control the electric motor drive operation and preset a program for alteration of the handrail spacing.

For instance, a multiturn potentiometer may be employed as a transmitter 35, a digital voltmeter as an indicator 37, a pushbutton switch as a selector 38, a digital module designed on integrated circuits (adders) as a comparator 39, a well known thyristor converter as an electric motor control circuit 40.

To alter the distance between the handrails, set the desired size on the selector 38 and start the electric motors. The electric motors will impart rotation through the reduction gears 11, output shafts 12 and bevel gears 25 and 17 to the lead screws 13 of the handrail spacing adjusters 6. The nuts 15 moving along the lead screws will move the uprights closer together or further apart. The rotational motion is transmitted simultaneously to the lead screws 18. As a result, the nuts 19 moving along the lead screws 18 will displace rods 20 and 21 together with rollers 22 and 23 held by the cables so that the rollers 22 are always in an intimate contact with the profiled surfaces of the tension compensating correctors 24. Therefore, as the nuts 19 move along the lead screws 18, the cable tension is automatically maintained substantially constant in line with the displacement of the handrails. The screw pair compensates for variation of the cable position, while the cable tension (changed also due to the fact that the top end of each upright under adjustment follows an arc) is corrected by the tension compensating corrector 24 whose profiled surfaces are formed by second-degree curves.

The use of the tension compensating corrector 24 allows the accuracy of the bracing cables in the course of alteration of the handrail spacing to be increased to within the tolerances fixed by the FIG. regulations, i.e. within $2750 \pm 150$ N.

The uprights and handrails continue to move so long as the signals of the handrail position transmitters 35 and selector 38 remain different from each other. The signal difference is applied through the comparator 39 to the electric motor control circuit 40. As soon as the balance of the signals is attained, the electric motors stop operating, and the numeral corresponding to the preset handrail spacing will be read off the handrail position indicator 37.

To ensure dependable operation of the bars in the event of an emergency cutting-off of the power supply even for a short time or in case the uneven bars are installed in a place where provision of electric power supply presents difficulties or is inexpedient, the uneven bars are equipped with the hand drive cranks 8. To alter the handrail spacing by means of the hand drive crank 8, move the latter axially towards the gear-box case 14 together with the rotation axle. As a consequence, the bevel gear 27 mounted on the axle 26 of the crank 8 meshes with the bevel gear 25, thereby bedding linked with the handrail spacing adjuster 6 and cable tension automatic control device 7. The bell-crank lever 29 engaged with the crank 8 overcomes the force of the spring 33, splits the tooth-type coupling consisting of half-couplings 30 and 31, thereby disengaging the reduction gear 11 together with the electric motors.

With the electric motors energized safe operation of the uneven bars is ensured due to the fact that the half-couplings are held engaged by the springs 33, in which case the bell-crank levers 29 keep the hand drive cranks 8 shifted to the extreme outward position, bringing the bevel gears 27 out of mesh with bevel gears 25. In case of an inadvertent movement of the hand drive crank 8 inwards, separation of the tooth-type coupling elements disengaging the electric motors and the reduction gears 1 will always preceed meshing of the bevel gears 27 mounted on the axle 26 of the hand drive crank 8 with the bevel gears 25.

The use of the proposed uneven bars considerably increases the intensity of competitions and training of sportsmen and makes it possible to dispense with hand labour due to an automatic and quick adjustment of the handrail spacing.

What we claim is:

1. Uneven bars, comprising:

two bases;

two parallel handrails;

two pairs of uneven uprights, each of said pairs of uneven uprights being pivotally attached at their lower ends to one of said bases and both pairs carrying said handrails at the upper ends of said uprights;

a pair of tensioning cables bracing the upper ends of one of said pairs of uprights;

a cable tension automatic control device for each pair of said uneven uprights;

a handrail spacing adjuster connected between the uprights of each pair of uneven uprights and linked mechanically with said cable tension automatic control device of the corresponding pair of uneven uprights;

a hand drive crank axially displaceable with respect to each of said handrail spacing adjusters;

means permitting said axial displacement of each said crank for enabling connection of each crank to the respective handrail spacing adjuster;

an electric motor for driving each of said handrail spacing adjusters;

a reduction gear mechanically connected between each electric motor of said cable and the tension automatic control device of the corresponding pair of uneven uprights; and an interlocking device for preventing simultaneous operation of the hand drive crank and the electric motor of each pair of uneven uprights, each interlocking device being engaged with said hand drive crank and coupled to a kinematic train interconnecting said reduction gear of said electric motor and said cable tension automatic control device of each pair of said uneven uprights.

2. In the uneven bars, as set forth in claim 1, the combination of a common electric control system for controlling said electric motors; handrail position transmitters belonging to said common electric control system and linked mechanically with said handrail spacing adjusters; a handrail position indicator associated with said common electric control system and electrically connected to said handrail position transmitters; a remotely operated handrail spacing selector electrically connected with said handrail position transmitters and which produces outputs; a comparator incorporated in said common electric control system and wired with the outputs of said handrail spacing selector and handrail position indicator through said comparator.

3. The uneven bars according to claim 1 wherein each said interlocking device comprises a bell-crank lever and a tooth-type coupling; said reduction gear has an output shaft; a first half-coupling slidably mounted on said reduction gear output shaft; a means for moving said first half-coupling along the output shaft; a lead screw of said cable tension automatic control device; a second half-coupling of said tooth-type coupling mounted on said lead screw; a means of elastically holding the first half-coupling slidably mounted on the reduction gear output shaft against the second half-coupling fixed on the lead screw; one arm of said bell-crank lever kept always in contact with said hand drive crank; a sleeve freely enclosing the second half-coupling fixed on the lead screw; a second arm of the bell-crank lever carrying said sleeve and constantly kept in contact through said sleeve with the first half-coupling mounted on the reduction gear output shaft.

4. The uneven bars in accordance with claim 1 wherein each of said cable tension automatic control devices is fitted with rods and a cable tension compensating corrector; a nut running along a lead screw of each cable tension automatic control device and carrying pivotally attached said rods; a roller installed on one of the rods and embraced by said cable; a roller mounted on another rod, at which an end of said cable is fixed; said tension compensating corrector fixed on the longer upright of said pair of the uneven uprights and having oneprofiled surface formed by a second-degree curve and brought in permanent contact with the roller at which the cable fixedly terminates.

* * * * *